US005776042A

United States Patent [19]

Szabo

[11] Patent Number: 5,776,042

[45] Date of Patent: Jul. 7, 1998

[54] ABDOMINAL EXERCISE DEVICE

[76] Inventor: William J. Szabo, 10126 Langmuir Ave., Sunland, Calif. 91040

[21] Appl. No.: 660,209

[22] Filed: Jun. 3, 1996

[51] Int. Cl.[6] ..... A63B 23/02

[52] U.S. Cl. ..... 482/140; 482/131; 482/142

[58] Field of Search ..... 482/78, 92, 95, 482/131, 132, 133, 135–142, 148, 908

[56] References Cited

U.S. PATENT DOCUMENTS

| | | | |
|---|---|---|---|
| 1,244,371 | 10/1917 | Reynolds . | |
| 1,705,745 | 3/1929 | Anderson | 482/133 |
| 1,911,572 | 5/1933 | Hulander et al. . | |
| 2,429,939 | 10/1947 | Masterson et al. . | |
| 2,446,275 | 8/1948 | Glasin . | |
| 2,475,289 | 7/1949 | MacGregor . | |
| 2,563,407 | 8/1951 | Haims . | |
| 2,722,967 | 11/1955 | Reinholz . | |
| 3,591,173 | 7/1971 | Cossman . | |
| 4,182,511 | 1/1980 | Camp, Jr. | 482/140 |
| 4,183,520 | 1/1980 | Chase . | |
| 4,241,949 | 12/1980 | Parker . | |
| 4,282,868 | 8/1981 | Riggs | 482/131 |
| 4,307,880 | 12/1981 | Abram . | |
| 4,314,697 | 2/1982 | Brumfield et al. . | |
| 4,367,870 | 1/1983 | Birch . | |
| 4,405,128 | 9/1983 | Mclaughlin et al. . | |
| 4,489,936 | 12/1984 | Dal Monte . | |
| 4,582,319 | 4/1986 | Luna . | |
| 4,729,562 | 3/1988 | Pipasik . | |
| 4,818,018 | 4/1989 | Yamasaki | 482/142 |
| 4,863,158 | 9/1989 | Tassone . | |
| 4,902,003 | 2/1990 | Buoni . | |
| 4,949,960 | 8/1990 | Harlan | 482/133 |
| 5,100,130 | 3/1992 | Shoebrooks . | |
| 5,122,107 | 6/1992 | Gardner . | |
| 5,125,650 | 6/1992 | Paris . | |
| 5,256,126 | 10/1993 | Grotstein . | |
| 5,290,209 | 3/1994 | Wilkinson | 482/140 |
| 5,300,005 | 4/1994 | Wang . | |
| 5,346,447 | 9/1994 | Stearns . | |
| 5,441,473 | 8/1995 | Safani et al. . | |
| 5,466,205 | 11/1995 | McLane et al. | 482/140 |
| 5,492,520 | 2/1996 | Brown . | |
| 5,567,202 | 10/1996 | Hager | 482/140 |

FOREIGN PATENT DOCUMENTS

| | | | |
|---|---|---|---|
| 2537007 | 6/1984 | France | 482/133 |
| 2622118 | 4/1989 | France | 482/133 |

*Primary Examiner*—Jeanne M. Clark
*Attorney, Agent, or Firm*—Sand & Sebolt

[57] ABSTRACT

An abdominal exercise device includes a first U-shaped frame member pivotally attached to a second U-shaped frame member. Each frame member includes a pair of spaced parallel legs and a cross section extending therebetween. A head rest is mounted on the cross section intermediate the legs of the first frame member. An adjustable pivot tube is telescopically mounted within each leg of the first frame member to adjust the length of the legs. The legs of the first and second frame members are pivotally attached to each other generally adjacent the free ends thereof. A pair of spaced flexible straps extend between the cross sections of the frame members. A spring-biased detent pin is mounted within the hollow interior of each of the legs of the first frame member and is selectively engaged in holes formed in the legs of the first frame member to provide linear adjustment to the first frame member. A user lies on a support surface between the frame members and the user's head is positioned on the head rest and the second frame member is grasped by the user. The free ends of the second frame member pivots on the support surface as the user performs a sit-up or an abdominal crunch. The device can be flipped upside-down and used to perform reverse crunches. The device is collapsible for compact and easy storage.

11 Claims, 4 Drawing Sheets

FIG-7
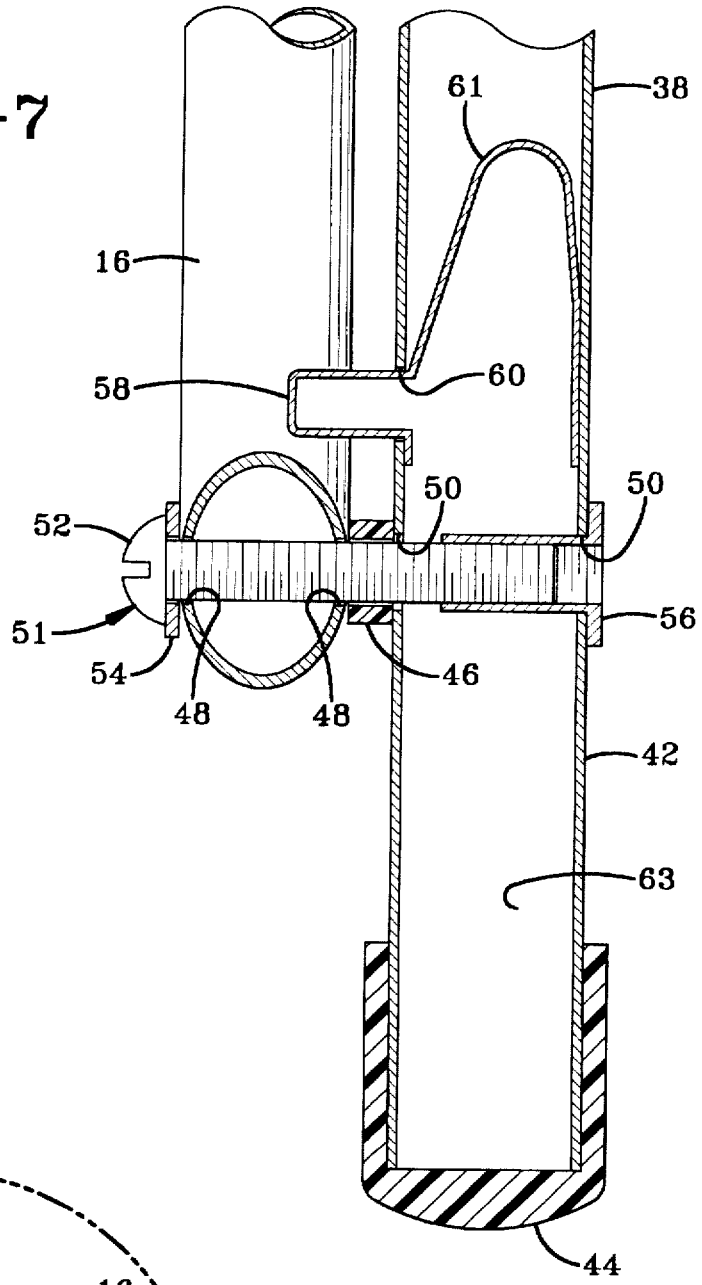
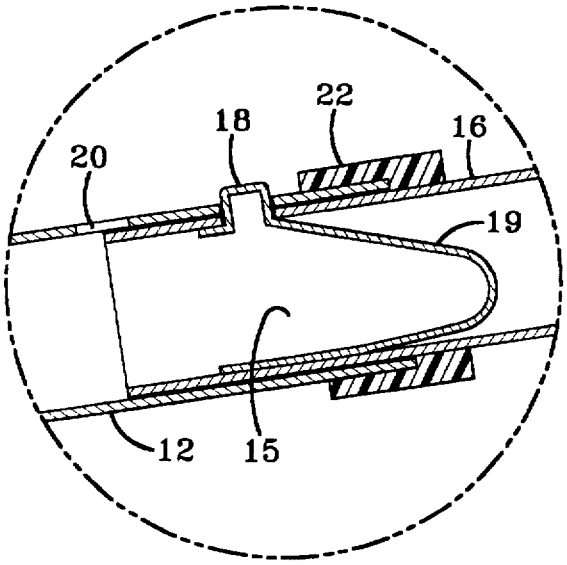
FIG-8

ABDOMINAL EXERCISE DEVICE

BACKGROUND OF THE INVENTION

1. Technical Field

The invention relates to exercise devices. More particularly, the invention relates to an abdominal exercise device. Even more particularly, the invention relates to an exercise device which allows a user to safely and effectively exercise the upper and lower abdominal muscles and oblique muscles, and provide support to the user's head and neck during the exercises, and which is collapsible into a compact position for easy storage.

2. Background Information

Those skilled in the art of exercise generally accept that for an exercise device to be effective the device must provide, or preferably obligate a body movement in a plane or planes which effectively recruit the muscles of the body part to be exercised. It must permit a full range of motion of the body part so as to effectively exercise the desired muscles throughout their entire length and it must provide a variable resistance so as to progressively challenge the muscles, thereby strengthening and toning the desired muscles specific to the exercise.

Conventionally, the sit-up exercise is performed with the user's hands clasped behind the neck to prevent hyperextension of the neck and thus impingement of the sensitive cervical spine facet joints. However, with the hands clasped behind the user's neck there is a tendency for the neck to be hyperflexed by the pulling forces of the user's arms. Hyperflexion of the neck increases the loading on the cervical spine discs predisposing the discs to excessive compression strain and thereby increasing the potential for disc rupture and herniation. Furthermore, hyperflexion of the neck places a long axis traction stress to the posterior cervical musculature and may result in muscular strain or sprain.

Many prior art devices have been developed which prevent hyperflexion of the neck while performing sit-up exercises. U.S. Pat. No. 4,863,158 shows a device which uses resistance weights to progressively challenge the muscles while avoiding lower back stresses during the sit-up movement. A sit-up bar has a central neck bow which curves behind the user's neck and which extends between a pair of straight sections. A handle extends forward from each straight section to properly position the user's hands when performing the sit-up.

U.S. Pat. No. 5,100,130 shows a flexible board of a fixed length and width upon which the user lies while performing the abdominal exercises. The board supports the user's head, neck and back during use of the device.

U.S. Pat. No. 5,125,650 shows an exercise device with a U-shaped frame having legs pivotally attached to the legs of a U-shaped base. The frame has a sling of flexible material which extends between its legs and cross member and the frame is adjustably supported in an angular position on the base by a riser.

U.S. Pat. No. 5,346,447 utilizes the vertically downward weight of the user to provide resistance during the exercise. An adjustable pivot point and a roller ball allow the resistance to be varied.

U.S. Pat. No. 5,441,473 shows a compact back exercise device with a base including a seat, and a pair of arm pivotally mounted to the sides of the base. A cross piece extends between the arms and a resistance device extends between each arm and its respective side of the base. The user positions himself on the seat wherein the cross-piece extends across the user's back. The user leans backwards to exert a force against the cross-piece while the resistances exert a force against the arms in an opposite direction.

Further examples of prior art abdominal exercise devices are shown in U.S. Pat. Nos. 4,405,128, 4,582,319, 5,122,107, 5,256,126 and 3,300,005.

Although these prior art devices are presumably adequate for the purpose for which they were intended, the present invention improves upon some of the drawbacks of these devices. Some of the drawbacks of these prior art devices are that they require a large amount of space to both use and store. Also, in order to progressively increase or decrease the resistance the user must stop during his workout and adjust the machine.

Thus, the need exists for an abdominal exercise device which obligates a body movement in a plane or planes which effectively recruit the muscles of the body part to be exercised; which permits a full range of motion of the body part so as to effectively exercise the desired muscles throughout their entire length; which provides a simple manner to vary the resistance and to progressively challenge the muscles; which provides neck and lower back support; which is compact in size both during use and storage; and which is inexpensive to manufacture, ship, and assemble. There is no such exercise device of which we are aware which accomplishes these results.

SUMMARY OF THE INVENTION

Objectives of the present invention include providing an exercise device which safely and effectively isolates the upper and lower abdominal muscles and oblique muscles.

A further objective of the present invention is to provide such an exercise device which provides neck support while performing the various exercises.

Another objective of the present invention is to provide such a device which permits progressive resistance by varying the placement of the hands along the length of an upper body frame of the device.

A still further objective of the present invention is to provide such a device which is easily adjustable to allow operation by users of different upper body lengths while still providing neck support.

Another objective of the present invention is to provide such a device which is lightweight, compact and easily collapsible allowing the device to be both used and stored in a small amount of space.

A further objective of the present invention is to provide such a device which is constructed of a lightweight tubing which is relatively inexpensive to manufacture and ship, yet provides a safe and steady exercise device.

Another objective of the present invention is to provide such a device which includes two tubular U-shaped members pivotally connected at their legs and a pair of straps which extends between their cross members; and which can be used to perform a usual sit-up or abdominal crunch as well as a reverse abdominal crunch.

The exercise device of the present invention accomplishes these objectives by obligating a body movement similar to that of a "sit-up" and recruiting the upper and lower fibers of the abdominal muscles and oblique muscles. The device may be adjusted to fit the body dimensions of users of various sizes and thus ensure a full range of motion of the exercise in an ideal plane of movement so as to maximally recruit the abdominal muscles. The device provides for a plurality of hand grasp positions whereby the user may vary his or her hand position to progressively increase or decrease the resistance to the exercise. The device includes adjustable straps which allow the user to widen the distance between the two cross members which allows the cross members to be positioned on the floor and used in performing reverse abdominal crunches.

These objectives and advantages are obtained by the exercise device of the present invention the general nature of which may be stated as including a first frame member having a pair of spaced legs and a cross section which extends therebetween; a second frame member having a pair of spaced legs and a cross section which extends therebetween; a pivot mechanism pivotally connecting each leg of said second frame member to one leg of said first frame member permitting said frame members to move between a collapsed storage position and an open operating position; and retention means extending between the two frame members to retain the second frame member in an angular relationship to the first member when in the open operating position.

BRIEF DESCRIPTION OF THE DRAWING

The preferred embodiment of the invention, illustrative of the best modes in which applicants have contemplated applying the principles, is set forth in the following description and is shown in the drawings and is particularly and distinctly pointed out and set forth in the appended claims.

FIG. 7 is a greatly enlarged fragmentary sectional view taken from line 7—7, FIG. 3; and FIG. 8 is a greatly enlarged fragmentary sectional view of the encircled portion of FIG. 4.

Similar numbers refer to similar parts throughout the drawings.

DESCRIPTION OF THE PREFERRED EMBODIMENT

Figure 1:
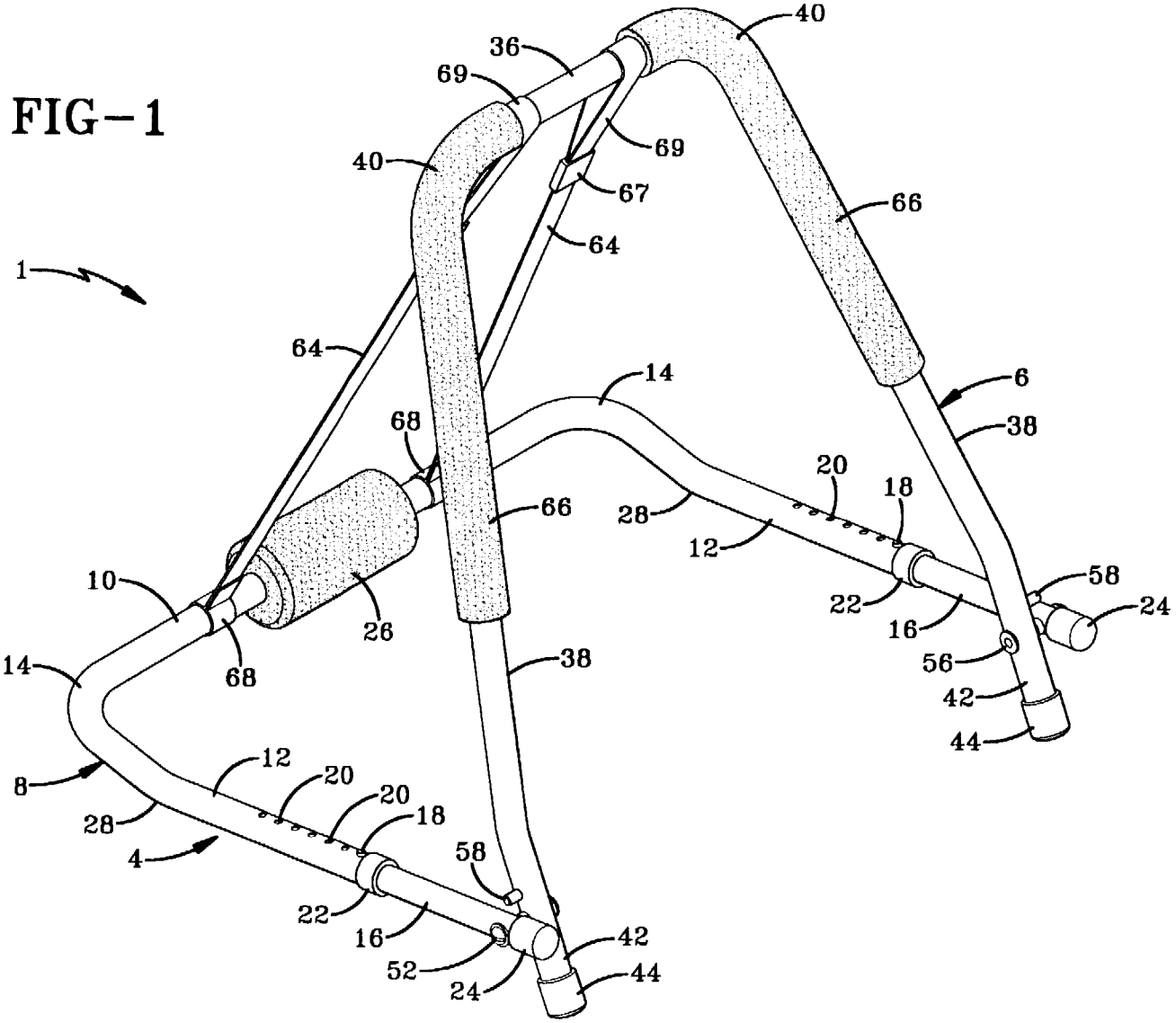
FIG. 1 is perspective view of the exercise device of the present invention shown in a first operating position.

The exercise device of the present invention is indicated generally at 1 in FIG. 1, and includes a lower horizontal support tube or first frame member, indicated generally at 4, pivotally attached to an upright tube or second frame member, indicated generally at 6. Tubes 4 and 6 are substantially U-shaped and preferably are fabricated of a twenty gauge steel tube stock.

Support tube 4 includes a U-shaped head rest tube 8 which has a pair of spaced legs 12, a cross member 10 and a pair of curved corners 14 extending therebetween. A pair of pivot tubes 16 telescopically slidably fit into the open end of each leg 12. Each pivot tube 16 is adjustably secured to leg 12 by a usual spring-biased detent 18 (FIG. 8). Detents 18 are formed integrally with U-shaped leaf springs 19 which are mounted within the hollow interiors 15 of tubes 16 and snap-fit within one of a plurality of adjustment holes 20 formed in and spaced along each leg 12, and allow support tube 4 to be adjusted to accommodate users of various sizes.

A plastic bushing 22 extends around the end of each leg 12 and a plastic cap 24 is mounted on the outer open end of each pivot tube 16 to prevent injury from the respective exposed ends. A cylindrical-shaped padded head rest 26, formed of resilient foam or the like, is mounted on cross member 10 of head rest tube 8 intermediate corners 14 for comfortably supporting a users head and neck during use of device 1. A slight upward bend or elbow 28 may be formed in head rest tube 8 adjacent corners 14 to support cross member 10 above a support surface 30 (FIG. 2A).

Upright tube 6 includes a pair of spaced legs 38, a cross member 36 and a pair of curved corners 40 extending therebetween. Each leg 38 is angled inwardly between an end section 42 thereof and its respective curved corner 40. A thin sleeve 66 of non-slip material, such as a foam rubber, is disposed over each leg 38 and corner 40. Sleeves 66 extend from the midpoint of legs 38 upwardly to a position partially across cross member 36 and provide a cushioned non-slip surface which is comfortable to grasp and which prevents slipping from the user's hand. A rubber cap 44 is mounted on the outer open end of each section 42 to prevent injury and to stabilize device 1 on support surface 30 while being used to perform abdominal exercises.

A pair of aligned holes 48 (FIG. 7) is formed in each pivot tube 16 adjacent end cap 24 and a second pair of aligned holes 50 is formed in each end section 42 adjacent end cap 44. Legs 38 of upright tube 6 extend between pivot tubes 16 of lower support tube 4 and are pivotally connected thereto by a nut and bolt pivot assembly 51, having a circular low friction spacer 46 separating pivot tubes 16 from legs 38. Assembly 51 includes a bolt 52 which extends through holes 48, spacer 46 and holes 50. A washer 54 is positioned between the head of bolt 52 and the outer surface of each pivot tube 16, and a flange nut 56 extends into each outermost hole 50 and threadably engages bolt 52. A spring-biased detent pin 58 may be formed integrally with a U-shaped leaf spring 61 which is mounted within the hollow interior 63 of tube end section 42 and extends through a hole 60 formed in end section 42 to restrict the downward pivotal movement of upright tube 6.

In accordance with one of the features of the invention, a pair of spaced parallel adjustable straps 64 are positioned on each side of head rest 26 and extend between cross members 10 and 36 of tubes 4 and 6, respectively. Straps 64 are preferably nylon and include looped ends 68 which extend around cross member 10 and which are formed by folding over one end of each strap and box stitching the end back to the main portion of the strap. A usual buckle 67 extends from the other end of each strap 64 and loops around cross member 36 between foam sleeves 66 forming a loop 69. Buckles 67 are fastened to the main portion of straps 64 between cross members 10 and 36 of tubes 4 and 6, respectively, and allow the user to adjust the straps to fit the user's particular body and arm length. Straps 64 restrict the upward pivotal movement of upright tube 6 creating an angle A (FIG. 4) between upright tube 6 and support tube 4 when device 1 is in its full open operating position, which is approximately 75°.

Figure 2:
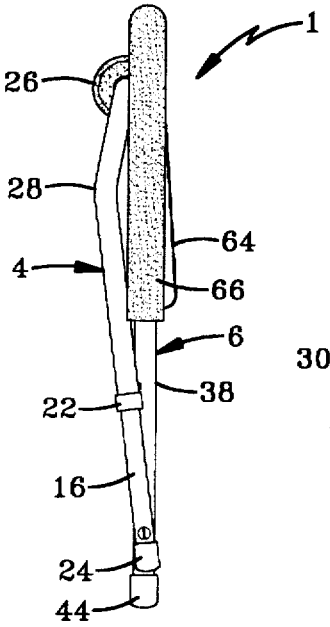
FIG. 2 is a reduced side elevational view of the exercise device of FIG. 1 in a collapsed position.
Figure 2A:
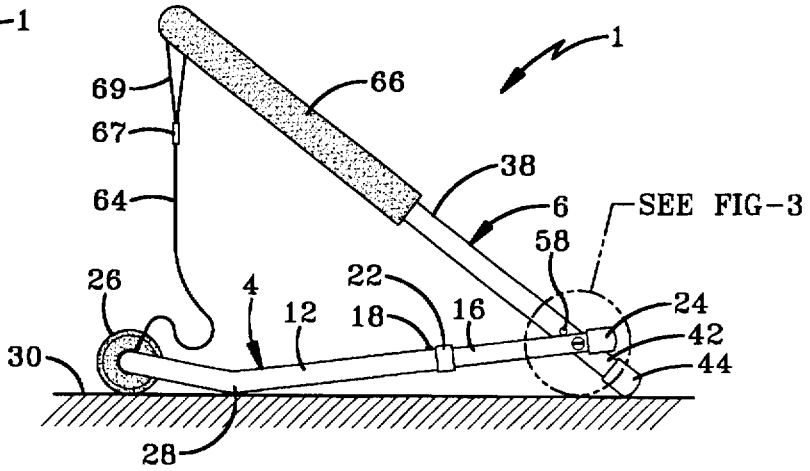
FIG. 2A is a side elevational view similar to FIG. 2 showing the exercise device in a partially open position.
Figure 3:
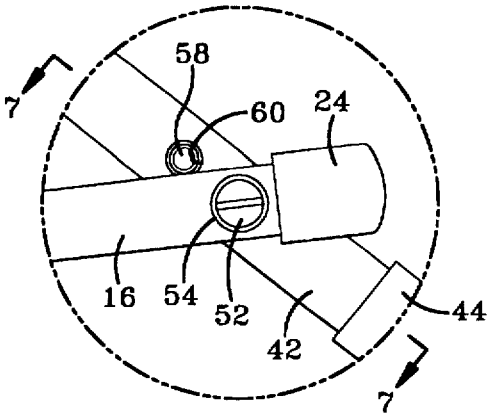
FIG. 3 is a greatly enlarged fragmentary elevational view of the encircled portion of FIG. 2A.

In use, support tube 4 of device 1 is positioned horizontally on support surface 30 while in the collapsed configuration of FIG. 2. If pins 58 are used, they are depressed inwardly and upright tube 6 is pivoted upwardly until detent pins 58 clears pivot tubes 16 and snap outwardly to lock upright tube 6 in the position of FIG. 2A. Pivot tubes 16 are adjusted to accommodate users with torsos of various sizes by pushing in detent pins 18 and sliding pivot tubes 16 in either direction to align head rest 26 with the user's head wherein rubber caps 44 of legs 38 are positioned adjacent the user's hip (FIGS. 4 and 5) when device 1 is in use. The user uses buckle 67 to adjust the length of straps 64 to allow the user to grasp sleeves 66 of cross member 36 and corners 40 while lying in the horizontal position.

Figure 4:
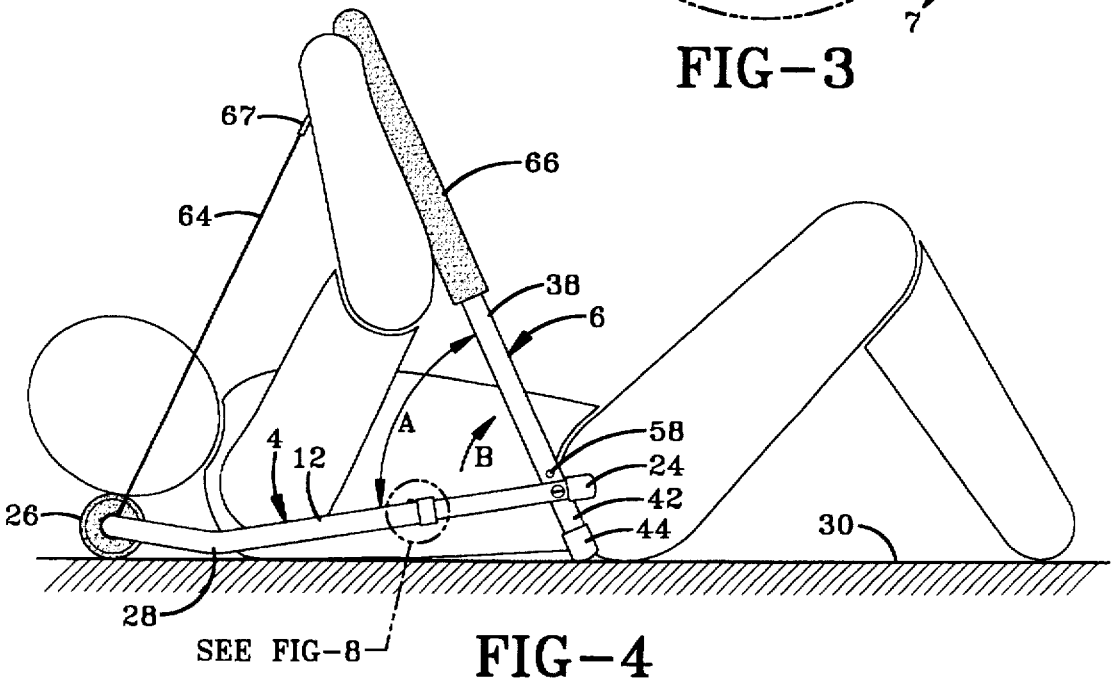
FIG. 4 is a side elevational view showing the exercise device of FIG. 2A in a fully open position just prior to a user performing a sit-up exercise.
Figure 5:
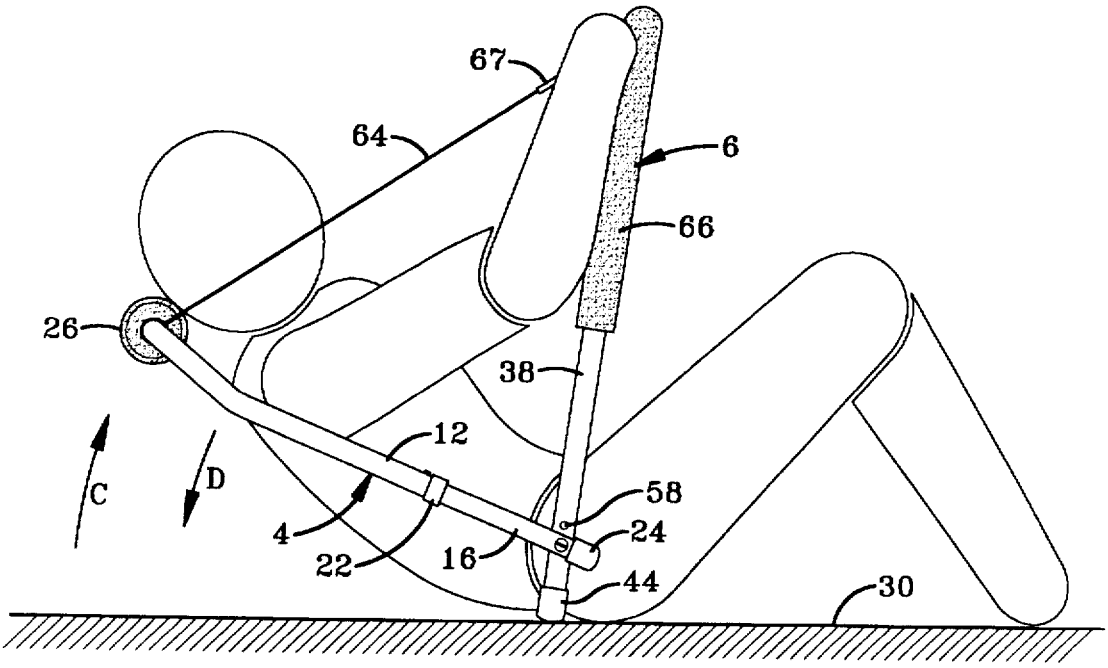
FIG. 5 is a side elevational view similar to FIG. 4 showing the exercise device being operated by the user at the upper position of the sit-up exercise.

The user lies horizontally between spaced legs 12 and pivot tubes 16, as shown in FIG. 4, and the user's head is positioned on head rest 26. The user grasps sleeves 66 of legs 38 of upright tube 6 and pivots the upright tube upwardly in the direction of arrow B (FIG. 4) until straps 64 are taunt. The hand position of the user may be varied along the sleeve to increase the resistance while performing the exercises.

The knees of the user are bent and the user's feet are positioned flat on support surface 30. The user's abdominal muscle is contracted at the user's naval and the user's shoulder blades and head are lifted off of support surface 30 in the direction of arrow C (FIG. 5) performing a usual sit-up procedure. The user's arms are bent at the elbow and apply a slight forward pressure on upright tube 6 to maintain constant contact between head rest 26 and the user's head to provide support therefor. The weight of the user's head on head rest 26 produces a downward pressure or torque on upright tube 6 which keeps rubber caps 44 of legs 38 in constant contact with support surface 30 as device 1 is pivoted upwardly and rubber caps 44 provide traction and stability to the device during operation by the user.

The user's head is then slowly lowered in the direction of arrow D (FIG. 5) applying a negative resistance to the user's abdominal muscles. The user maintains the abdominal muscle contraction as device 1 pivots downwardly on end caps 44. This abdominal crunch exercise is repeated to strengthen the user's upper and lower abdominal muscles and oblique muscles.

Figure 6:
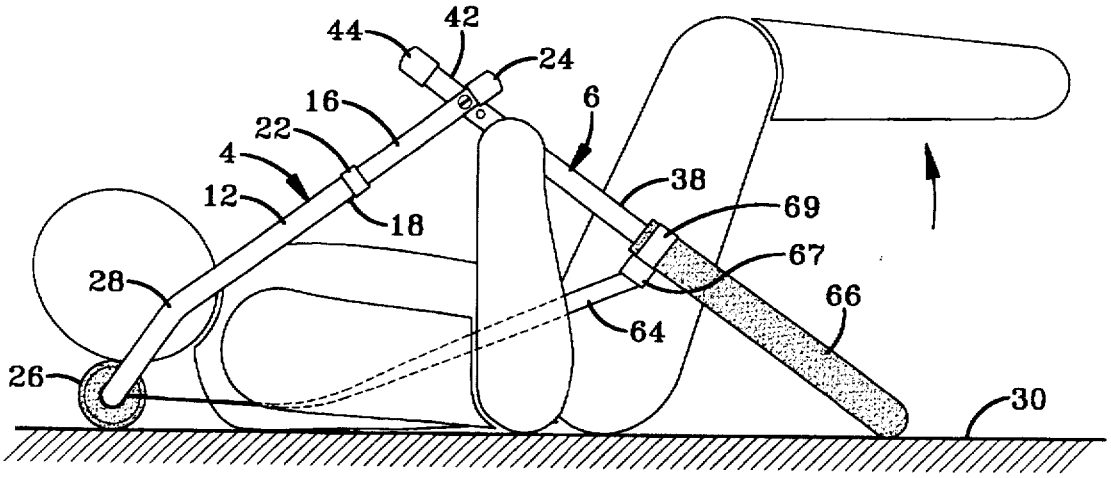
FIG. 6 is a side elevational view showing the user operating the exercise device to perform a reverse abdominal crunch.

In accordance with another feature of the invention, device 1 can be used to perform a reverse abdominal crunch. The users lengthens straps 64 by sliding buckle 67 towards cross member 36 thereby decreasing the size of loops 69. The user flips device 1 upside-down and positions head rest 26 and cross member 36 of upright tube 6 on support surface 30. Pivot tubes 16 are adjusted as described above so that cross member 36 is beyond the buttocks of the user. The user lies between legs 12 and legs 38, and the user's head is positioned on head rest 26. The user's elbows are positioned adjacent support surface 30 with the user's arms at an approximate 90° angle, and the user grasps legs 38 generally adjacent pivot assembly 51. The user's knees are bent and the user's feet are positioned flat on support surface 30. The user's lower abdominal muscles are contracted and the user's knees are pivoted toward the user's chest as shown in FIG. 6. The user's legs are slowly returned to their original position and the abdominal contraction is maintained providing a negative resistance to the abdominal muscles.

Another exercise that may be performed using device 1 is an oblique crunch wherein the user's legs are positioned sideways on support surface 30 on one side of the user's body and the user's upper torso is rolled upwardly to work the user's oblique muscles. The user's legs are alternated between the side of the user's body to exercise both sides of oblique muscles.

In accordance with another feature of the invention, device 1 is collapsible for compact easy storage. Device 1 is stored by depressing detent pins 58 and pivoting upright tube 6 toward support tube 4 until device 1 is in the collapsed folded position of FIG. 2, wherein the frame members lie in juxtaposition to each other.

Accordingly, exercise device 1 has a simple lightweight construction which includes two U-shaped tubes pivotally attached to one another at the outer ends of their legs. Further, pivot tubes 16 are adjustable to vary the length of support tube 4, and upright tube 6 includes inwardly angled legs 38 which provide multiple hand grasp positions to vary the resistance of the exercise. Also, straps 64 maintain an approximate 75° angle between support tube 4 and upright tube 6, and head rest 26 comfortably supports the user's head during use of device 1. If detents 58 are used, they can be easily depressed to allow the device to collapse to a compact folded position for ease of storage. Furthermore, straps 64 are adjustable to widen the distance between cross members 10 and 36 of tubes 4 and 6, respectively, to allow device 1 to be used for reverse crunches as shown in FIG. 6.

Accordingly, the improved abdominal exercise device is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved abdominal exercise device is constructed and used, the characteristics of the construction, and the advantageous, new and useful results obtained; the new and useful structures, devices, elements, arrangements, parts and combinations, are set forth in the appended claims.

I claim:

1. An exercise device, including:

a generally U-shaped first frame member having a pair of spaced legs and a cross section which extends therebetween;

a generally U-shaped second frame member having a pair of spaced legs and a cross section which extends therebetween;

a pivot mechanism pivotally connecting each leg of said second frame member to a respective leg of said first frame member permitting said frame members to move between a collapsed storage position and an open operating position;

retention means extending between the two frame members to retain the second frame member in an angular relationship to the first member when in the open operating position; and said cross sections of the frame members being located at a first end of the device and the pivot mechanism being located at a second end opposite said first end thereby forming a void area between the legs and cross section of each of the first and second frame members and forming an open end at said second end whereby the user can lay down in a supine position through said open end between the frame member and perform abdominal exercises by moving the device while said device provides support for the user.

2. The exercise device defined in claim 1 in which the legs of the second frame member extend between the legs of the first frame member.

3. The exercise device defined in claim 1 in which a cushioned headrest is mounted on the cross section of the first frame member.

4. The exercise device defined in claim 1 in which the retention means includes a pair of flexible straps which extend between the first and the second members.

5. The exercise device defined in claim 4 in which the straps are spaced and parallel and extend between the cross sections of the first and second frame members.

6. The exercise device defined in claim 5 in which each strap includes an adjustable buckle which allows the distance between the cross sections of the first and second members to be adjusted.

7. The exercise device defined in claim 1 in which each of the spaced legs of the first and second frame members terminate in free ends; and in which a protective cap is mounted to each free end of the legs of the second frame member to frictionally stabilize the device on a horizontal support surface when in the open operating position.

8. The exercise device defined in claim 1 including adjustment means for adjusting the lengths of the legs of the first frame member.

9. The exercise device defined in claim 8 in which the adjustment means includes a spring-biased detent pin mounted within a hollow interior of a first section of each of the legs of the first frame member, and a plurality of holes is formed in a second section of each leg of said first frame member, said first section of each leg is telescopically engaged with the second section of each leg.

10. The exercise device defined in claim 1 in which each of the legs of the first frame member includes an angled bend.

11. The exercise device defined in claim 1 in which the first and second frame members form an included angle of generally 75° when in the open operating position.

* * * * *